United States Patent [19]

Minovitch

[11] Patent Number: 5,072,342

[45] Date of Patent: Dec. 10, 1991

[54] LIGHT GUN

[76] Inventor: Michael A. Minovitch, 2832 St. George St. #6, Los Angeles, Calif. 90027

[21] Appl. No.: 480,859

[22] Filed: Feb. 16, 1990

[51] Int. Cl.[5] ..... F41G 11/00

[52] U.S. Cl. ..... 362/111; 362/187; 362/265

[58] Field of Search ..... 362/109, 112, 263, 265, 362/187, 110, 111

[56] References Cited

U.S. PATENT DOCUMENTS

| | | | |
|---|---|---|---|
| 3,049,611 | 8/1962 | Kluge | 362/265 X |
| 4,171,811 | 10/1979 | Meyer et al. | 362/112 X |
| 4,367,516 | 1/1983 | Jacob | 362/112 X |
| 4,586,715 | 5/1986 | Scolari et al. | 362/112 X |
| 4,823,242 | 4/1989 | Maglica et al. | 362/187 |

*Primary Examiner*—Ira S. Lazarus
*Assistant Examiner*—Sue Hagarman
*Attorney, Agent, or Firm*—Christie, Parker & Hale

[57] ABSTRACT

A hand-held pulsed-light generator is presented for temporarily blinding and assailant at a distance. The light generator comprises a high energy storage capacitor, charged by high voltage power supply, and a high intensity flashtube. A high current electronic switch discharges the capacitor through the flashtube thereby generating an intense flash of light. The flash is focused by a reflector to form a concentrated beam pulse which is aimed at an assailant's head. The intensity of the pulsed-light beam striking the eyes is sufficiently strong to cause temporary blindness, thereby rendering the assailant immobile. By using a discharge capacitor with very high energy storage, and an ultra high intensity flashtube, and a focusing relector for concentrating the light, it is possible to project a light flash that is several orders of magnitude brighter than the sun. As soon as the capacitor is discharged be generating one light flash, it is automatically recharged a few seconds later for projecting another flash. Rapid fire of several flashes with time intervals of a small fraction of a second is obtained by utilizing a plurality of capacitors, and discharging them serially through the flashtube.

7 Claims, 1 Drawing Sheet

LIGHT GUN

BACKGROUND

The amount of violent crime committed in the United States against defenseless victims is very high. Many individuals have resorted to carrying pistols for self protection. But carrying a concealed weapon such as a pistol requires a gun permit which, in many states, is difficult to obtain. Consequently, various other devices have been invented for self protection that are relatively easy to obtain. These include devices for producing an electric shock (called "stun guns"), or devices for projecting a chemical substance into the eyes of an assailant such as "Mace". Other devices are designed to sound an alarm such as blowing a horn or whistle.

Unfortunately, carrying a lethal weapon such as a pistol can result in death if the victim is overpowered by the assailant. The use of a stun gun to shock an assailant requires physical contact with the assailant. But this close proximity operation makes the victim vulnerable to being overpowered. Projecting Mace into the eyes of an assailant is not very effective unless the victim is relatively close to the assailant, and hence vulnerable to being overpowered. Sounding an alarm is useless against a determined assailant.

The device introduced herein is designed to render an assailant instantly immobile from a safe distance by temporarily blinding the assailant with an intense flash of light. Since most violent attacks occur at night in a dark environment, such a device or "light gun" can be extremely effective. It will immobilize the assailant long enough to allow the victim to escape to safety. Since the flash is projected at the speed of light, it could even be used when the assailant is carrying a gun thereby making it impossible to aim and fire.

SUMMARY OF THE INVENTION

Thus, in the practice of this invention, the presently preferred embodiment typically comprises a plurality of high energy storage capacitors that are charged by a high voltage power supply energized by batteries, and a high intensity flashtube. A high current electronic switch (thyristor) discharges each capacitor, serially, through the flashtube thereby providing the capability of generating multiple intense flashes of light with arbitrarily short time intervals between each flash. Each flash is focused by a reflector to form a concentrated beamed light flash which is aimed at the eyes of an assailant. The duration of each light flash is on the order of of 1/600 of a second (1.7 milliseconds) which is quicker than an eye blink. Thus, it is impossible to avoid receiving the flash by closing the eyes if the eyes were open when a light flash is fired. By using capacitors with very high energy storage and an ultra high intensity flashtube, and concentrating each flash into a beam by a parabolic reflector, it is possible to generate and project a beamed light flash that is several orders of magnitude brighter than the sun. Receiving a light flash with this intensity can cause total blindness in the eyes of an assailant for up to 60 seconds or more. Each capacitor can be regarded as a "light bullet" that is fired by the thyrister trigger. Six capacitors are used in the preferred embodiment so that the device can be regarded as a "six-shooter light gun". When a capacitor is fired (i.e., discharged), a high voltage recharging system, powered by 6 ordinary 1.5 volt C size batteries, automatically recharges the capacitor. The recharging time for each capacitor is about 20 seconds. Thus, it requires about 2 minutes for the light gun to automatically recharge itself after six rapid shots are fired. The parabolic reflector is mounted on a movable platform such that the distance between the center of the light source inside the flashtube and the focal point of the reflector can be varied. This enables the beam divergence angle to be varied so that a narrow beam can be projected with high intensity over relatively great distances. It also enables the beam to diverge with a relatively large angle so that the eyes of several assailants can be temporarily blinded simultaneously by a single shot fired at close range. In the preferred embodiment, all of the above mentioned components are mounted inside a housing that resembles an ordinary 3-cell flashlight that can be carried in a man's pocket or in a woman's purse.

DRAWINGS

These and other advantages and features of the invention will be apparent from the disclosure, which includes the specification with the foregoing and ongoing description, the claims, and the accompanying drawings wherein:

DESCRIPTION OF THE PREFERRED EMBODIMENT

Figure 1:
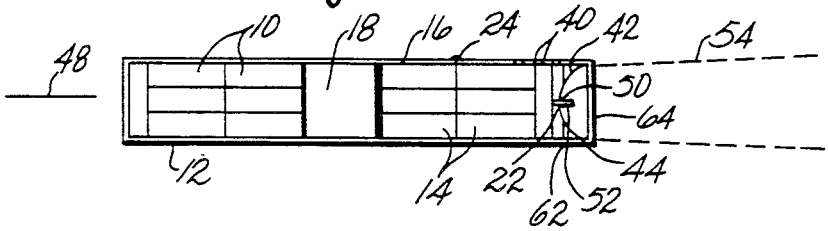
FIG. 1 is a schematic longitudinal cross-section illustrating the design and construction of the preferred embodiment of the invention.

As described above, the present invention provides a relatively small, hand-held pulsed-light generator designed for temporarily blinding the eyes of a would-be assailant at a distance with a concentrated flash of light several orders of magnitude brighter than the sun. Basically, this is accomplished by discharging a very high energy storage capacitor through a high power flashtube, concentrating the resulting light flash by a parabolic reflector thereby boosting the intensity to very high levels, and projecting it into the eyes of an assailant. A high voltage power supply, energized by ordinary flashlight batteries, automatically recharges the capacitor several seconds later so that it can be used for firing another shot.

Before describing the preferred embodiment, it is useful to consider some basic theoretical aspects in order to demonstrate the enormous intensity of the light flash that can be produced and beamed into a person's eyes with this invention. Let C denote the capacitance of a capacitor that is charged with a voltage V. The amount of energy E (Joules) stored in the capacitor is give by the equation $$E=\frac{1}{2}CV^2$$

In the practice of this invention, typical values for C and V will be 4,000 μf (microfarads) and 800 volts respectively. The corresponding stored energy E=1,280 Joules. This energy is equivalent to that expended by lifting a weight of one pound up a vertical height of 941 feet. When this stored electrical energy is discharged through the flashtube (typically a high power Xenon flashtube) the duration ΔT of the light flash will be approximately 1/600 seconds (1.7 milliseconds). Consequently, the average power P generated by the discharge will be $P=W/\Delta T=768{,}000$ Watts (768 KW). Assuming that the flashtube has an electric-to-radiant energy conversion efficiency of 50%, the actual light power will be about 384 KW. Assuming that the parabolic reflector spreads the light beam pulse to a diameter of 0.5 m (1.64 feet) when it strikes the eyes of the assailant, the intensity of the light flash entering the eyes will be 1,955 $KW/m^2$. This is approximately 2,000 times brighter than that of the noon-day sun. (The effect would be equivalent to watching a 50 KT nuclear explosion at five miles without any eye protection.) Since the flash is so short, it is impossible to avoid it by blinking the eyes. Hence, the assailant will be instantly blinded by the flash for at least a minute (probably much longer) and therefore rendered completely immobile. Thus, it is submitted that the present invention represents an extremely effective device for neutralizing an assailant at a safe distance without having to resort to lethal force.

Unfortunately, if the first shot misses the eyes of the assailant, the high voltage power supply (that is energized by a set of batteries) will require several seconds to recharge the capacitor before another shot can be fired. During this recharging time, the assailant could approach and overpower the victim. Consequently, in the preferred embodiment of the invention, several high energy storage capacitors will be utilized instead of one.

By using state of the art capacitors with very high energy density, the size of a 4,000 μf, 800 volt storage capacitor will be approximately equal to that of a standard 1.5 volt C battery. Thus, in the preferred embodiment of the invention, 6 storage capacitors will be used along with 6 ordinary 1.5 volt C batteries. This will enable the light gun to be fired six times in rapid succession with arbitrarily short time intervals before the gun is completely discharged.

Figure 2:
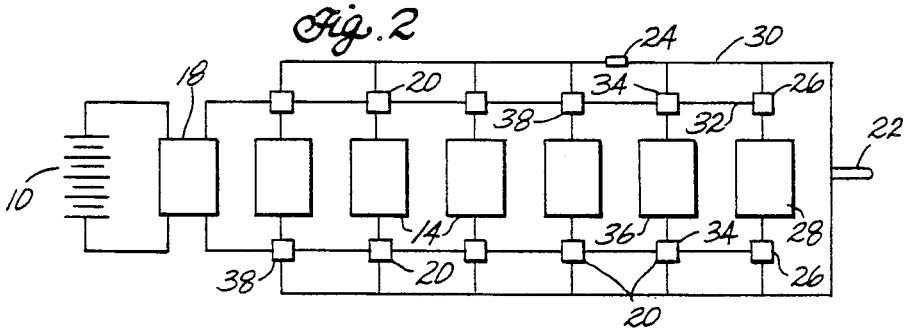
FIG. 2 is a schematic diagram illustrating the basic circuit design of the preferred embodiment of the invention with six storage capacitors.
Figure 3:
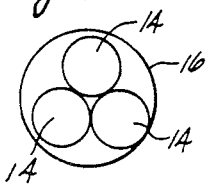
FIG. 3 is a schematic transverse cross-section through the capacitors further illustrating the design of the preferred embodiment.
Figure 4:
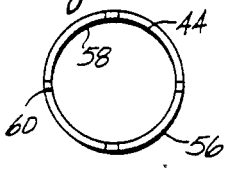
FIG. 4 is a schematic transverse cross-section through the parabolic reflector.

FIG. 1 is a schematic longitudinal cross-section illustrating the design and construction of the preferred embodiment of the invention. FIG. 2 is a schematic diagram illustrating the basic circuit design of the preferred embodiment. FIG. 3 is a schematic transverse cross-section through the storage capacitors of FIG. 1, further illustrating the design and construction. Referring to FIGS. 1–3, the 6 size C batteries 10 are mounted in two groups of 3 batteries each inside a cyclindrical housing 12 (with an outside diameter of about 2.3 inches). The 6 storage capacitors 14 are mounted (FIG. 3) on a fixed frame 16 that is itself mounted inside the housing 12 with a mounting configuration similar to that of the batteries 10. The capacitor bank 14 and batteries 10 are separated from each other by a high voltage power supply 18. This power supply 18 converts the 9 volts generated by the serially connected batteries 10 into 800 volts used for charging the storage capacitors 14.

As is shown in the circuit diagram of FIG. 2, the storage capacitors 14 are mounted individually with pairs of high current switches 20 designed to automatically connect each capacitor 14 to the flashtube 22 via a high current thyristor trigger 24 in a sequence, one at a time. Thus, before the first shot is fired, the first pair of switches 26 are closed so that the first capacitor 28 is connected to the firing circuit 30, while the remaining switches 20 are kept open, isolating the remaining five capacitors from the firing circuit 30. After the first shot is fired, the first pair of switches 26 are automatically opened, disconnecting the first capacitor 28 from the firing circuit 30, and simultaneously connecting it to the high voltage power supply 18 via wires 32 so that the capacitor 28 is automatically recharged. As soon as the first capacitor 28 is fired, the second pair of switches 34 automatically close thereby instantly connecting the second capacitor 36 to the firing circuit 30 while all of the remaining switches 20 stay open. As soon as the second shot is fired, the second pair of switches 34 automatically open thereby disconnecting the second capacitor 36 from the firing circuit 30. The design of the switching circuit 38 is such that the second capacitor 36 is not connected to the high voltage power supply 18 until the first capacitor 28 is fully charged. A ready light 40 is connected to each capacitor 14 that senses the voltage. If the capacitor has the required fully charged voltage (800 volts), the ready light 40 corresponding to that capacitor goes on indicating that the capacitor is fully charged. The design of the switching circuit 38 is such that each capacitor is fired and recharged in the same sequence (1,2,3,4,5,6) so that if several seconds passes after the first shot is fired, but the last shot is still not fired, the first capacitor 28 will have time to become fully recharged before the last shot is fired. Consequently, after the sixth shot is fired, the first capacitor 28 is automatically reconnected to the firing circuit 30 by the first pair of switches 26. If the sixth shot is never fired, the first five capacitors will eventually become fully recharged (one after another). Thus, the gun will automatically reload itself (i.e., recharge itself). If Alkaline batteries are used, the light gun will be capable of firing about 100 shots before the batteries require replacing.

The high power flashtube 22 (which could be an Xenon model KD-403 flashtube) is rigidly mounted on the internal mounting frame 16. A high quality parabolic mirror 42 (i.e., reflector) is mounted on a movable frame 44 adjacent the end of the fixed frame 16 such that the longitudinal focal axis 46 of the parabolic mirror 42 lies along the central longitudinal axis 48 of the cylindrical housing 12. The parabolic mirror 42 is constructed with a relatively small central hole 50 and is mounted on the movable frame 44 so that the flashtube 22 protrudes through the hole 50 such that the focal point 52 of the mirror 42 (and the focal axis 46) can be moved a small distance through the light source inside the flashtube 22. This allows the light beam 54 to have an adjustable divergence angle that can be made very small for projecting the light pulse with ultra high intensity over a long distance. By adjusting the beam divergence angle to be relatively large (e.g., 30° or greater) the light flash will form a brilliant cone with sufficient intensity to blind the eyes of a group of assailants simultaneously, rendering them immobile for several seconds. The parabolic reflector 42 is moved along the central axis 48 by rotating a movable sleeve 56 fitted with grooves 58 that spiral around the inside surface of the sleeve 56 to form a screw. A plurality of flanges 60 ride inside the grooves 58 that are connected to the rim 62 of the parabolic mirror 42 such that the mirror 42 can be moved along the central axis 48 by rotating the sleeve 56. Thus, the beam divergence angle can be adjusted by rotating the sleeve 56. A high quality quartz glass window 64 is mounted in front of the parabolic mirror 42.

The circuit diagram shown in FIG. 2 is intended to explain the basic electronic design and operating principles of the preferred embodiment using a plurality of storage capacitors 14 for rapid fire operation. The detailed design and operating principles of the various components such as the high voltage power supply 18, flashtube 22, thyristor trigger 24, ready lights 40, sensors, and the firing circuit 30 are similar to those used in ordinary repeating flash cameras well known in that art. Likewise, the detailed design of the switching citcuit 38, and the various sensors and switches 20 involve well known devices and operating principles in the art of electronics. Thus, the detailed design of these components are not provided herein as they involve prior art.

Figure 5:
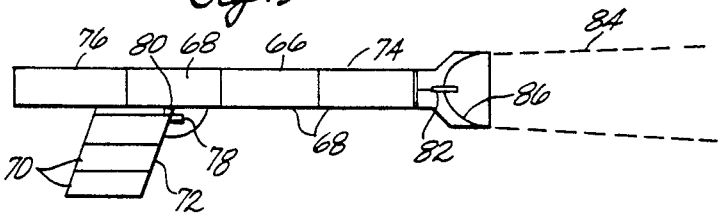
FIG. 5 is a schematic longitudinal cross-section illustrating the design and construction of a "pistol" embodiment of the invention.

FIG. 5 is a schematic cross-section illustrating an alternative embodiment of the invention. In this embodiment, the external frame 66 has the form of a small pistol. Three high energy capacitors 68 are mounted inside the pistol 66 which enable three shots to be fired before recharging (i.e., it is a "three-shot" pistol). The batteries 70 are mounted inside the hand grip 72 and the capacitors 68 are mounted inside the barrel 74. The high voltage power supply 76 is mounted behind the capacitors 68. The trigger 78 is connected to the thyristor switch 80 which fires the flashtube 82. The flash is concentrated into a beam 84 by the focusing reflector 86 mounted at the end of the barrel 74.

Figure 6:
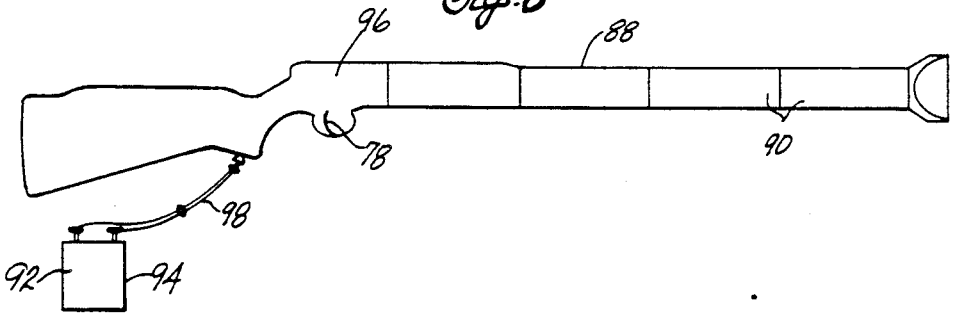
FIG. 6 is a schematic cross-section illustrating a "shotgun" embodiment of the invention.

Many other embodiments of the invention are possible. For example, it could be constructed as a "shotgun" 88 (FIG. 6) with extremely high energy capacitors 90 (exceeding 10,000 Joules stored energy). In this embodiment, the batteries 92 can be mounted in an external battery pack 94, which is connected to the high voltage power supply 96 by an electric cord 98.

Other embodiments may use a powerful strobe light instead of a flashtube to generate the light pulse.

Many modifications and variations of the above embodiments can be devised by one skilled in the art without departing from the scope of the invention. Thus, it is intended that all matter contained in the above description or shown in the accompanying drawings should be interpreted as illustrative and not in a limiting sense.

What is claimed is:

1. A device for immobilizing one or more persons at a distance comprising:

a plurality of high energy capacitors;

means for charging said capacitors with a voltage exceeding 100 volts;

a light generating means;

switching means for generating a series of light flashes by discharging said capacitors sequentially through said light generating means such that the second light flash can be generated by said switching means before any discharged capacitor is recharged;

reflector means for concentrating said light flashes into a plurality of diverging beam pulses with very high intensity; and means for mounting said capacitors, charging means, light generating means, switching means, and reflector means in a hand-held housing such that said beam pulses can be aimed and projected into the eyes of said person (persons) thereby temporarily blinding said person (persons) and rendering said person (persons) immobile.

2. A device as set forth in claim 1 further comprising means for changing the divergence angle of said beam pulses.

3. A device as set forth in claim 1 wherein said means for charging said capacitors comprises a high voltage power supply energized by direct current battery means.

4. A device as set forth in claim 1 further comprising means for recharging said capacitors after generating said series of light flashes.

5. A method for immobilizing one or more persons at a distance comprising the steps of:

charging a plurality of capacitors;

generating a series of light flashes of short duration by discharging said capacitors through a light generator with no substantial waiting period between successive light flashes;

concentrating said light flashes by a reflector means thereby creating a series of pulsed light beams with very high intensity; and projecting said high intensity pulse beams into the eyes of said person (persons) thereby temporarily blinding said person (persons) rendering said person (persons) immobile.

6. A method as set forth in claim 5 further comprising the step of varying the divergence angle of said beam pulses to vary the effective range of said beam pulses.

7. A method as set forth in claim 5 further comprising the step of recharging said capacitors after generating said beam pulses.

* * * * *